US006520868B2

(12) United States Patent
Chen

(10) Patent No.: US 6,520,868 B2
(45) **Date of Patent: *Feb. 18, 2003**

(54) GOLF CLUB HEAD OF STEEL ALLOY

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/801,910

(22) Filed: Mar. 9, 2001

(65) Prior Publication Data

US 2002/0173373 A1 Nov. 21, 2002

(51) Int. Cl.[7] ..... A63B 53/04; A63B 53/06; A63B 53/08; C22C 38/18; C22C 38/20; C22C 38/22; C22C 38/24; C22C 38/26; C22C 38/30; C22C 38/32; C22C 38/34; C22C 38/36; C22C 38/38; C22C 38/40; C22C 38/58

(52) U.S. Cl. ..... 473/324; 473/349; 148/325; 420/108

(58) Field of Search ..... 148/325, 327; 420/36, 42, 35, 43, 63, 69, 68, 87, 8, 108; 473/342, 345, 349, 324, 346, 350, 348; 72/341

(56) References Cited

U.S. PATENT DOCUMENTS 4,314,863 A * 2/1982 McCormick ..... 148/37
5,630,888 A * 5/1997 Yoshida et al. ..... 148/325
5,683,310 A * 11/1997 Chen ..... 473/349
5,967,905 A * 10/1999 Nakahara et al. ..... 473/345
6,334,817 B1 * 1/2002 Ezawa et al. ..... 473/324
6,350,209 B1 * 2/2002 Chen ..... 473/342

OTHER PUBLICATIONS

Roudakov et al., Future Flight Test Plans of an axisymmetric Hydrogen–Fueled Scramjet Engine on the Hypersonic Flying Laboratory, Nov. 18–22, 1996, AIAA 96–4572, Norfolk, Virginia.*

* cited by examiner

*Primary Examiner*—Sebastiano Passaniti
*Assistant Examiner*—Sneh Varma
(74) *Attorney, Agent, or Firm*—Browdy and Neimark, P.L.L.C.

(57) ABSTRACT

A golf club head which comprises a steel alloy which contains maximum amounts of 0.03% of C by weight, 0.2~0.6% of Si by weight, maximum amounts of 0.15% of Mn by weight, maximum amounts of 0.03% of P by weight, maximum amounts of 0.03% of S by weight, 10.5–13.5% of Cr by weight, 0.8–1.4% of Mo by weight, 0.8–1.4% of Al by weight, 0.8~1.4% of Ni by weight, 0.02~0.1% of Nb by weight, maximum amounts of 0.01% of N by weight, maximum amounts of 0.03% of Cu by weight, and the rest being Fe. The steel alloy is made by a metallurgical method involving vacuum melting process and normalizing process, whereby the main crystal structure of the steel alloy is Fe.

12 Claims, No Drawings

GOLF CLUB HEAD OF STEEL ALLOY

FIELD OF THE INVENTION

The present invention relates generally to a golf club, and more particularly to a golf club head, which can absorb impact when hitting.

BACKGROUND OF THE INVENTION

When a golfer hitting a ball with a golf club, most of the force is generating at the moment when the golf club head contacting with the ball. A large impact and vibration will transfer from the head to the shift of the golf club. Finally, it will transfer to the golfer. The impact and the vibration will decrease the performance of hitting. To prevent above problem, conventional golf club head is made of a damping material, which has the capacity of absorbing vibration. The advantage of the head is to absorb the impact and vibration by the material itself when hitting the ball. Thus, the golfer can grip the golf club all the time when hitting ball. The other advantage of the golf club head, which is made of the damping material, is to increase the time of the golf club head in contact with the ball. According to the theory, it will rise the ball controllability.

Most of the damping material applied to the convention golf club head is S25C steel, pure magnesium or pure aluminum. However, the damping property of the S25C steel (the constituents and some mechanical properties of the S25C are shown in Table 2 and Table 3) is not good enough ($Q^{-1}=0.5\times10^{-2}$). So, the golf club head made of S25C steel can not provide a good capacity of absorbing impact and vibration as the designer wants. Beside that, the S25C steel has a poor property of anti-rust. the pure magnesium and pure aluminum provided a good capacity of absorbing impact and vibration, but they has a lower strength property and not easy to weld to the other elements of the golf club head in a strong status.

SUMMARY OF THE INVENTION

The primary objective of the present invention is to provide a golf club head which has a capacity of absorbing impact and vibration when hitting a ball.

Another objective of the present invention is to provide a golf club head which has a good capacity of anti-rust and easy to weld.

The present invention provides an alloy steel to achieve the objectives of the present invention. The golf club head of the present invention desirably has a head shell, a face and a neck, wherein at least one of which is made of the steel alloy. The constituents of the steel alloy comprise maximum amounts of 0.03% of C by weight, 0.2~0.6% of Si by weight, maximum amounts of 0.15% of Mn by weight, maximum amounts of 0.03% of P by weight, maximum amounts of 0.03% of S by weight, 10.5~13.5% of Cr by weight, 0.8–1.4% of Mo by weight, 0.8–1.4% of Al by weight, 0.8~1.4% of Ni by weight, 0.02~0.1% of Nb by weight, maximum amounts of 0.01% of N by weight, maximum amounts of 0.03% of Cu by weight, and the rest being Fe. The steel alloy is made by a metallurgical method whereby the main crystal structure of said steel alloy is ferrite.

DETAILED DESCRIPTION OF THE INVENTION

Before completing the alloy steel for the present invention. The inventor of the present invention made seven test alloys (F1~F7) with a variety of constituents and different quantities of the constituents. Measuring the material properties of the testing alloy to find the vary prescription of the steel alloy of the present invention.

Please refer to the Table 1, shown the constituents and some mechanical properties of the testing alloy. Each of the testing alloys being vacuum induction melting in a vacuum melting furnace. The temperature of casting set to 950° C.~1050° C. The temperature of rolling set to 950° C.~1050° C. The damping property of the testing alloys are tested by the method of resonance of audio frequency, the voltage is 15V. Tensile test is proceeded in an universal testing machine, and watching the crystal structures of the testing alloys with a microscope.

Analyzing the Table 1, hereunder are our conclusions:

1. For the crystal structures of the testing alloys, we found the F5 and F6 each has a double crystal structures of ferrite steel+pearlite steel. The damping properties ($Q^{-1}$) of the F5 and F6 testing alloy are 2.3 and 3.6, respectively. They are significantly smaller than the other testing alloys(F1~F4 and F7) which has a single crystal structure of ferrite steel. So, we conclude that the alloy with a single crystal structure of ferrite steel has a superior damping property.
2. Adding chromium (Cr) to the alloy can prevent rusting. According to Table 1, when the Cr exceeds 10 wt %, the damping property of the alloy will increase significantly. In comparison with F1 and F3, when the Cr increasing from 12 wt % to 15wt %, the value of the damping property did not change significantly, but decrease a lot in the percentage of elongation. Comparing with F1 and F6, the second crystal structure—pearlite steel will come out when there is about 10 wt % of Cr in the alloy. So, the optimum quantity of Cr is about 12 wt %.
3. When the testing alloy contained less than 0.005 wt % C, such as F2 and F7, the alloys had superior properties in damping and mechanical performance, But the alloys are difficult in metallurgical process. Thus, setting the quantity of C to ≦0.03 wt % is a good choice.
4. Adding Ni to increase the ductility of the alloy. Comparing F5 and F7, to prevent forming the double crystal structure of ferrite steel+pearlite steel, adding Ni only at a lower quantity of C to form a single crystal structure of ferrite steel of the alloy.
5. In comparison with F3 and F4, Al can increase the damping property of the alloy. But if there is a large quantity of Al, the alloy will form a double crystal structure. The optimum quantity of Al is about 1 wt %.
6. Adding a small quantity of Nb can make the crystal grain of the alloy fineness. The optimum quantity of Nb is about 0.04 wt %.
7. Adding Mo can strengthen the crystal base of the alloy, it also can increase the strength and the anti-rusting of alloy. The optimum quantity of Mo is about 1 wt %.
8. If the alloy had too much Si, it will increase the brittleness of the alloy. Too less of Si, it will decrease the damping capacity of the alloy. The optimum quantity of Si is about 0.35 wt %.

According to the conclusions above, the inventor of the present invention creates a steel alloy with a special prescription.

Please refer to the Table 2, wherein the steel alloy contains ≦0.001 wt % carbon (C), 0.3821 wt % silicon (Si), 0.0801 wt % manganese (Mn), 0.0119 wt % phosphorous (P), 0.0046 wt % sulfur (S), 12.45 wt % chromium (Cr), 1.219 wt % molybdenum (Mo), 0.942 wt % aluminum (Al), 1.178 wt % nickel (Ni), 0.045 wt % niobium (Nb), ≦0.01 wt % nitrogen (N), and ≦0.03 wt % copper (Cu), the rest mainly being iron (Fe). The steel alloy is made by a metallurgical method involving a vacuum melting process and a normalizing process at 950° C.×1 hr, whereby the main crystal structure of the steel alloy is ferrite steel.

Some of the mechanical properties of the steel alloy and the S25C steel are shown in Table 3. According to the data of Table 3, the damping coefficient of the steel alloy ($Q^{-1}=9.0\times10^{-2}$) is 18 times larger than that of the S25C steel ($Q^{-1}=0.5\times10^{-2}$). The steel alloy also has superior mechanical capacities than that of the S25C steel in yield strength, tensile strength, ratio of elongation and ratio of contraction.

The main reason of the damping coefficient of the present steel alloy being larger than the S25C steel is that the present steel alloy has a single crystal structure of ferrite steel, whereas the S25C steel has a double crystal structure of ferrite steel+pearlite steel. According to the theory of material science, the present steel alloy is softer and the crystal structure is uniform after normalizing. The present steel alloy can absorb forces in the vertical direction to the horizontal direction by the crystal boundary, so that the present steel alloy has a superior damping capacity than the S25C steel.

Next, wet put the present steel alloy and the S25C steel into seawater to test the anti-rusting capacities thereof.

Please refer to Table 4 for the result of the rusting test. The test results show that the present steel alloy had a bigger rusting quantity (0.0231 g/hm$^2$) and then decreased as time went on. After the 25$^{th}$ day of testing, the rusting quantity of the present steel alloy kept in 0.0003 g/hm$^2$. But the rusting quantity of the S25C steel, after the 18$^{th}$ day of testing, kept in 0.03 g/hm$^2$ it has 100 times the rusting quantity of the present steel alloy. Such test proves that the present steel alloy has a superior anti-rusting capacity compared to the S25C steel.

Now, we manufacture a golf club head using the steel alloy.

The golf club head has a head shell which is the main body of the head, a face which is the area to contact with the ball when hitting, fixed on the head shell and a neck fixed on the head shell for fixing a shaft of the golf club, wherein, the head shell and the neck can be made of SUS17-4PH, SUS15-5PH, SUS13-8PH, 255 stainless steel, pure titanium, titanium alloy, aluminum alloy, or tungsten-nickel alloy. The face is made of the above-described present steel alloy having a thickness of 3 mm (in practice, the thickness of the face can be made between 2.5 mm~4 mm), a hardness of HRB 80~HRB 90, and a tensile strength ranging between 50~62 kgf/mm$^2$.

There is another way to manufacture the face of the golf club head of the present invention. We shaped the present steel alloy into a board, and mounted the board on the face of the golf club head by brazing. The board can be attached on the face with overall surface contact thereof, and fixed by brazing.

The solder, which used in brazing the board on the face, is SUS309L. The constituents of the solder are shown in the table under:

| | C | Si | Mn | P | S | Cr | Ni |
|---|---|---|---|---|---|---|---|
| wt % | max 0.03 | max 0.08 | 1.0~2.0 | max 0.02 | max 0.02 | 22.0~25.0 | 11.0~14.0 |

We found the brazing performance is effected by the diameter of the solder and the voltage. The experience told us, when the diameter of the solders are 4.0 mm and 5.0 mm, there is a good brazing performance as the voltage are 130~180 A and 160~240 A, respectively.

Hereunder are the advantages of the golf club head of the present invention:

1. The S25C steel, the conventional damping material, has a double crystal structure of ferrite+pearlite, so it has a lower damping coefficient ($Q^{-1}=0.5\times10^{-2}$). The present steel alloy used for the golf club head of the present dig invention, has a single crystal structure of ferrite, so it has a higher damping coefficient ($Q^{-1}=9.0\times10^{-2}$), which is 18 times larger than the damping coefficient of S25C steel. Thus, the golf club head of the present invention provides a superior capacity of absorbing the impact and vibration when hitting a ball. That will enhance the stability and the controllability when hitting the ball.
2. The present steel alloy made for the golf club head of the present invention has a superior capacity of anti-rusting than the S25C steel previously used. So the golf club head of the present invention does not have to be plated with an anti-rusting coating on the surface, as opposed to the conventional golf club head. The golf club head of the present invention requires less procedure to manufacture thereof than the conventional golf club head, reducing the production cost.
3. The manufacturer can use the present steel alloy to make all or some of the parts of the golf club head, such as the head shell, the face and the neck, to provide different levels of the capacity of absorbing impact and vibration. The golf club head of the present invention can be a wood head, a iron head or a putter head.

TABLE 1

| | C | Si | Cr | Ni | Mo | Al | Nb | N | C + N | P | S | Damping coefficient ($Q^{-1} \times 10^{-2}$) | Yield strength (Mpa) | Tensile strength (Mpa) | Elongation (%) | Contraction (%) | Crystal structure |
|---|---|---|---|---|---|---|---|---|---|---|---|---|---|---|---|---|---|
| F1 | 0.039 | 0.26 | 12.05 | — | 1.16 | 0.96 | 0.048 | 0.0036 | 0.042 | <0.02 | <0.02 | 5.5 | 284.7 | 450.8 | 30.5 | 51.6 | Ferrite |
| F2 | 0.004 | 0.29 | 11.99 | — | 1.15 | 0.96 | 0.042 | 0.0042 | 0.0082 | <0.02 | <0.02 | 6.4 | 270.4 | 442.2 | 48.0 | 78.6 | Ferrite |
| F3 | 0.032 | 0.28 | 15.16 | — | 1.15 | 0.97 | 0.042 | 0.0032 | 0.0352 | <0.02 | <0.02 | 5.9 | 320.9 | 462.1 | 24.4 | 47.4 | Ferrite |
| F4 | 0.036 | 0.32 | 15.36 | — | 1.13 | — | 0.043 | 0.0032 | 0.0392 | <0.02 | <0.02 | 5.4 | 285.1 | 466.3 | 31.8 | 65.2 | Ferrite |
| F5 | 0.051 | 0.28 | 10.27 | 1.15 | 1.10 | 0.98 | 0.042 | 0.0038 | 0.0548 | <0.02 | <0.02 | 2.3 | 335.2 | 489.1 | 31.3 | 59.3 | Ferrite + Pearlite |
| F6 | 0.032 | 0.26 | 10.36 | — | 1.07 | 0.95 | 0.041 | 0.0032 | 0.0352 | <0.02 | <0.02 | 3.6 | 246.1 | 4118.8 | 39.0 | 76.4 | Ferrite + Pearlite |
| F7 | 0.005 | 0.26 | 10.21 | 1.18 | 1.08 | 0.95 | 0.041 | 0.0035 | 0.0085 | <0.02 | <0.02 | 7.6 | 282.4 | 437.2 | 39.6 | 76.2 | Ferrite |

unit: wt %
the rest is Fe

TABLE 2

| | C | Si | Mn | P | S | Cr | Mo | Al | Ni | Nb | N | Cu | Fe |
|---|---|---|---|---|---|---|---|---|---|---|---|---|---|
| Fecral | <0.001 | 0.3821 | 0.0801 | 0.0119 | 0.0046 | 12.45 | 1.219 | 0.942 | 1.178 | 0.045 | 0.008 | 0.212 | Bal |
| S25C | 0.22~0.28 | 0.1 max | 0.3~0.4 | 0.04 max | 0.05 max | — | — | — | — | — | — | — | Bal |

unit: wt %

TABLE 3

| | Damping coefficient ($Q^{-1} \times 10^{-2}$) | Yield strength (Mpa) | Tensile strength (Mpa) | Elongation (%) | Contraction (%) | Crystal structure |
|---|---|---|---|---|---|---|
| Fecral | 9.0 | 343 | 550 | 38 | 72 | Ferrite |
| S25C | 0.5 | 294 | 490 | 27 | 47 | Ferrite + Pearlite |

TABLE 4

| | Day | | | | | | |
|---|---|---|---|---|---|---|---|
| Alloy | 2 | 4 | 8 | 12 | 18 | 25 | 32 |
| Fecral | 0.0231 | 0.0024 | 0.0012 | 0.0006 | 0.0005 | 0.0003 | 0.0003 |
| S25C | −0.0047 | −0.020 | −0.023 | −0.026 | −0.030 | −0.030 | −0.030 |

unit: g/h $m^2$

What is claimed is:

1. A golf club head having a head shell, a face of said head shell and a neck for securing a shaft thereto, at least one of which is made of a steel alloy, the constituents of said steel alloy comprising maximum amounts of 0.03% of C by weight, 0.2~0.6% of Si by weight, maximum amounts of 0.15% of Mn by weight, maximum amounts of 0.03% of P by weight, maximum amounts of 0.03% of S by weight, 10.5~13.5% of Cr by weight, 0.8–1.4% of Mo by weight, 0.8–1.4% of Al by weight, 0.8~1.4% of Ni by weight, 0.02~0.1% of Nb by weight, maximum amounts of 0.01% of N by weight, maximum amounts of 0.03% of Cu by weight, and the rest being Fe;

said steel alloy being made by a metallurgical method involving a vacuum melting process, and a normalizing process at a predetermined temperature and a predetermined time, whereby the main crystal structure of said steel alloy is ferrite.

2. The golf club head as defined in claim 1, wherein said face of said golf club head has at least one sweet spot made of said steel alloy.

3. The golf club head as defined in claim 1, wherein said steel alloy is made into a board attaching on said face of said golf club head.

4. The golf club head as defined in claim 3, wherein said steel alloy is mounting on said face of said golf club head by brazing.

5. The golf club head as defined in claim 3, wherein said steel alloy is attaching on said face of said golf club head with overall surface and fixed by brazing.

6. The golf club head as defined in claim 3, wherein said steel alloy is attaching on said face of said golf club head by brazing; a solder, applied to braze, containing maximum amounts of 0.03% of C by weight, maximum amounts of 0.08% of Si by weight, 0.2~0.6% of Mn by weight, maximum amounts of 0.02% of P by weight, maximum amounts of 0.02% of S by weight, 22.0~25.0% of Cr by weight, and 11.0~14.0% of Ni by weight.

7. The golf club head as defined in claim 2, wherein said face of said golf club head has a thickness ranging between 2.5 and 4 mm.

8. The golf club head as defined in claim 1, wherein said face is made of said steel alloy, and is fixed on said head shell.

9. The golf club head as defined in claim 1, wherein said golf club head comprise a head shell; the material of said head shell is selected from SUS17-4PH, SUS15-5PH, SUS13-8PH, 255 stainless steel, pure titanium, titanium alloy, aluminum alloy and tungsten-nickel alloy.

10. The golf club head as defined in claim 9, wherein said head shell of said golf club head is manufactured by precise casting process and forging process.

11. The golf club head as defined in claim 1, wherein said steel alloy has a tensile strength of 50~62 kgf/mm$^2$.

12. The golf club head as defined in claim 1, wherein said ball-hitting face has a hardness of HRB 80~90.

* * * * *